US005245826A

United States Patent [19]

Roth et al.

[11] Patent Number: 5,245,826

[45] Date of Patent: Sep. 21, 1993

[54] VIBRATION SUPPRESSION APPARATUS FOR HYDRAULIC SYSTEM WITH IMPROVED ACCUMULATOR FILING CIRCUIT

[75] Inventors: Dieter Roth, Schlüchtern; Georg Rausch, Lorh/Main, both of Fed. Rep. of Germany

[73] Assignee: Mannesmann-Rexroth GmbH, Lohr/Main, Fed. Rep. of Germany

[21] Appl. No.: 933,683

[22] Filed: Aug. 24, 1992

[30] Foreign Application Priority Data

Sep. 5, 1991 [DE] Fed. Rep. of Germany ..... 4129509

[51] Int. Cl.[5] ..... F16D 31/02

[52] U.S. Cl. ..... 60/413; 60/420; 60/426; 60/468; 91/518

[58] Field of Search ..... 60/413, 417, 420, 421, 60/426, 459, 468, 431; 91/508, 511, 517, 518

[56] References Cited

U.S. PATENT DOCUMENTS

| | | | |
|---|---|---|---|
| 4,353,286 | 10/1982 | Wetter | 60/413 X |
| 4,706,930 | 11/1987 | Lexen | 60/413 X |
| 4,723,412 | 2/1988 | Buschmann | 60/431 X |
| 4,959,957 | 10/1990 | Schmale et al. | 60/413 |
| 4,995,517 | 2/1991 | Saotome | 60/413 X |
| 5,116,188 | 5/1992 | Kurohashi et al. | 60/413 X |
| 5,147,172 | 9/1992 | Hosseini | 60/413 X |

FOREIGN PATENT DOCUMENTS

| | | |
|---|---|---|
| 2502666 | 8/1976 | Fed. Rep. of Germany . |
| 3316085 | 11/1984 | Fed. Rep. of Germany . |
| 3909205 | 5/1990 | Fed. Rep. of Germany . |
| 52141594 | 4/1979 | Japan . |
| 54158391 | 1/1981 | Japan . |

*Primary Examiner*—Edward K. Look
*Assistant Examiner*—Hoang Nguyen
*Attorney, Agent, or Firm*—Emrich & Dithmar

[57] ABSTRACT

A hydraulic control circuit for building machinery includes a hydraulic cylinder to operate a tool. To stabilize vibrations of the tool around the pitch axis, a hydraulic accumulator is provided to be connected to a pressure source via a fill line. A shut-off valve is disposed in the fill line, which valve is subjected to the pressure in the accumulator such that in operating the cylinder the accumulator is loaded to a pressure corresponding to the load pressure. The system is very simple in structure and fluid losses are eliminated.

8 Claims, 1 Drawing Sheet

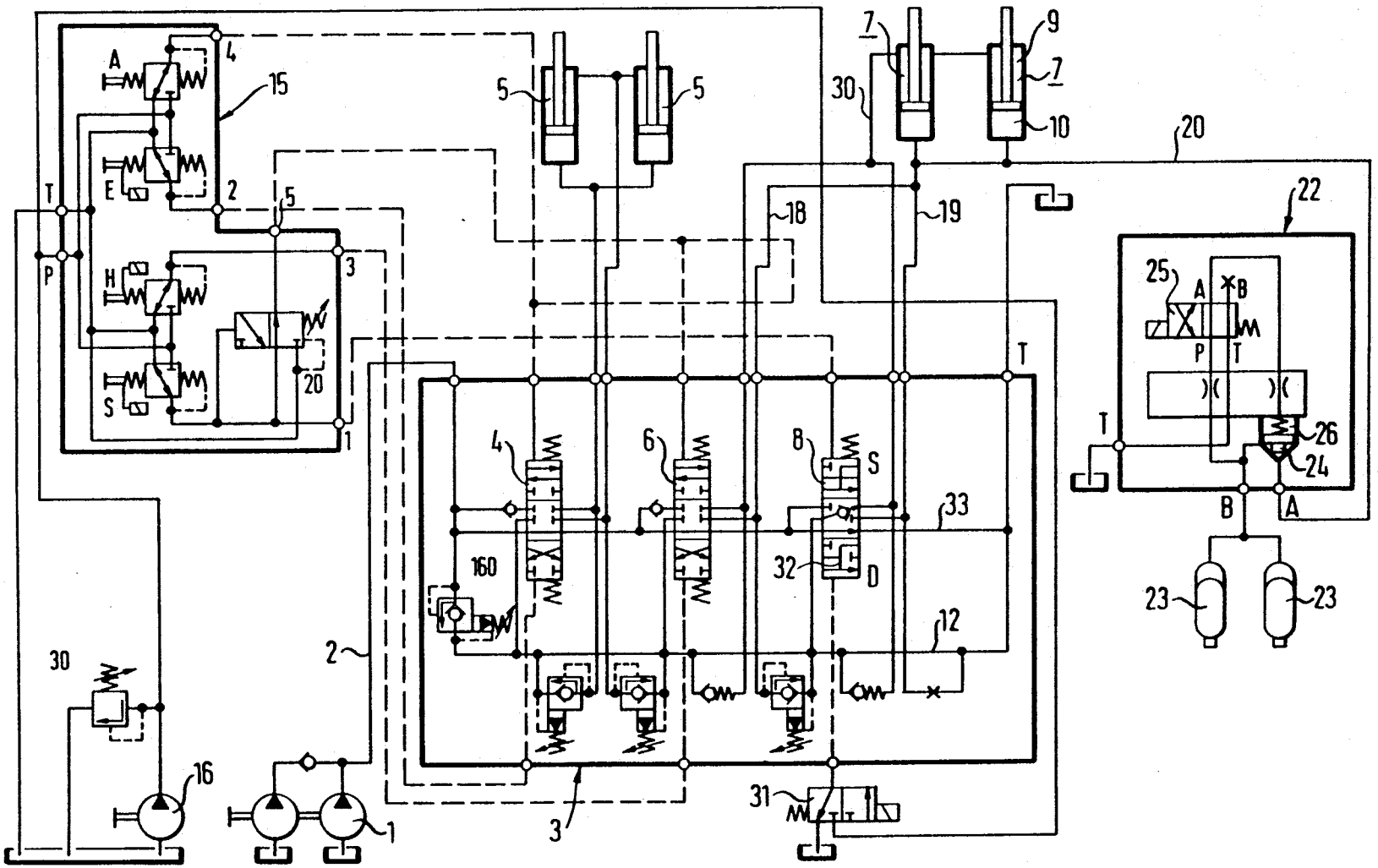
22
20
26
24
25
23
23
9
7
10
19
7
30
18
33
12
S
D
B
32
31
5
6
5
4
160
3
2
1
15
20
16
30
A
E
H
S
T
P

VIBRATION SUPPRESSION APPARATUS FOR HYDRAULIC SYSTEM WITH IMPROVED ACCUMULATOR FILING CIRCUIT

The invention relates to a hydraulic control apparatus for building machinery.

German 39 09 205 discloses a stabilizing system which is part of the hydraulic system of a building machine to dampen the pitch oscillations of the vehicle, in particular a fast running wheel loader with a full loading shovel. In the known system, the hydraulic cylinder for lifting the load, in particular the lift cylinder for lifting and lowering the loading shovel, is in fluid communication with a hydraulic accumulator which is loaded by the hydraulic pump through a pressure relief valve to the load pressure to be expected in the lift cylinder. A shut-off valve is disposed between the accumulator and the hydraulic cylinder. The shut-off valve is closed as long as the loading shovel is operative. The shut-off valve is opened by the operator as soon as the pitch oscillations occur when speeding up the vehicle. In order to prevent sagging-through of the load, i.e. the full shovel, it is essential to load the accumulator to a pressure which equals the load pressure to be expected.

It is an object of the present invention to simplify the connection of the hydraulic stabilizing accumulator to the hydraulic control apparatus of the vehicle. It is a further object to set the pressure in the accumulator to a proper value which does not result in undesired motions of the cylinder-operated tool when the stabilizing system is put in operation. Still further it is an object to avoid losses of fluid in the system.

The objects referred to and other features and advantages are attained by the invention.

According to the invention the filling line for the hydraulic stabilizing accumulator is connected to the hydraulic cylinder of the load-supporting tool via a shut-off valve. The shut-off valve is subjected to the pressure in the cylinder such that the accumulator is loaded when the working cylinder is actuated. The accumulator loading pressure equals the cylinder load pressure occurring. As the connection of the accumulator to the working cylinder is made through a single line only through which the accumulator is loaded as well, the system is substantially simplified, and there are no fluid losses which otherwise originate in a pressure relief valve disposed in a separate filling line.

While the shut-off valve in the filling line is kept closed by the accumulator pressure, the shut-off valve can be pressure-relieved by operating a control valve to open the shut-off valve.

When the accumulator is connected to the system, the cylinder chamber opposite the load pressure, i.e. the piston rod-sided cylinder chamber, should be connected to the reservoir to allow fluid to be displaced from the piston rod-sided chamber to the reservoir or, respectively, to draw in from the reservoir in accordance with motions of the piston resulting from pitching oscillations. According to the invention the connection to the reservoir referred to is provided by a directional control valve which is a standard equipment in this type of vehicles, in particular wheel loaders, having a working position in which both cylinder chambers are connected to each other to obtain a floating position which is useful, for example, when the shovel is used to level the ground. According to the invention, the conventional directional control valve is provided with an additional position into which the valve plunger is automatically switched when the shut-off valve is opened to connect the accumulator to the hydraulic system. In the additional position of the valve, the chamber of the working cylinder opposite the pressurized chamber is connected to the reservoir. To restrict the flow of fluid to the reservoir, the additional position may comprise a stop to maintain the plunger in a throttling position.

Other advantages and features of the invention will appear from the following description of a non-limiting embodiment with reference to the FIGURE which schematically shows a hydraulic control apparatus for a wheel loader.

In the drawings a pump 1 delivers pressurized fluid through a pump line 2 to a conventional directional control valve block 3 comprising a plurality of directional control valves to actuate associated working cylinders. In the embodiment shown there is provided a directional control valve 4 to actuate a pair of tilt cylinders 5, a directional control valve 6 to actuate a pair of lift cylinders 7 to operate the load shovel of a wheel loader and a directional control valve 8 which is disposed downstream of the directional control valve 6 and which has a working position "S" or, floating position in which the piston rod-sided cylinder chamber 9 of the lift cylinders and the piston-sided cylinder chambers 10 each are connected to each other. The directional control valve 8 still has a further position "D" which is explained below. The directional control valve 6 acts to lift and lower the lift cylinders. In the lift position of the valve, the piston-sided cylinder chamber 10 is connected to the pump pressure line 2 and the piston rod-sided cylinder chamber 9 to a reservoir line 12. The lift cylinders 7 actuate the loading shovel of a wheel loader.

The directional control valves 4, 6 and 8 are hydraulically actuated. For this a valve block 15 comprising a plurality of manually operated pilot valves is provided to adjust the working positions of the valves 4, 6 and 8 in a conventional manner. The pilot pressure delivered to the pilot valves is generated in a pilot pressure pump 16.

The piston-sided cylinder chambers 10 of the lift cylinders 7 are connected via lines 18, 19 each to the directional control valve 6 or, respectively 8. Furthermore, the chambers 10 are connected via a filling line 20 and a shut-off valve 22 to one or more damping accumulators 23. The shut-off valve 22 consists of a two-way seat valve 24 and a three-way valve 25 which is electrically controlled in the embodiment shown. In the illustrated position of the three-way valve 25 the control space 26 of the two-way seat valve 24 is connected to the port B of the shut-off valve 22, i.e. the pressure in the accumulator 23 engages the valve body of the seat valve to close the valve. When the three-way valve 25 is switched over, the control space 26 is connected to the reservoir through the port T so, that the control space 26 becomes pressure-relieved so that the valve member 24 opens to connect the accumulator 23 to the cylinder chambers 10 via the ports B and A. Accordingly, the building up of oscillations of the load shovel are substantially dampened.

The operation is as follows: The accumulator 23 is filled together with lifting the load by displacing the directional control valve in the position "lift" resulting in building up a corresponding pressure in the cylinder chambers 10. This pressure acts on the face of the valve member in the seat valve 24 facing the port A so that the valve 24 opens and pressurized fluid flows via the opened valve into the accumulator. When the accumulator pressure increases to a value equalling the load pressure in the cylinder chambers 10, the seat valve closes as the control space 26 of the seat valve is subjected to the accumulator pressure.

To connect the accumulator 23 to the lift cylinder 7, the three-way valve 25 is electrically operated, either manually by the operator or automatically, whereby the control space 26 of the seat valve 24 is connected to the reservoir such that the seat valve opens. The accumulator pressure equals the highest load pressure in the cylinder chambers 10 as the accumulator has been loaded before to this pressure via the line 20. From this it follows that dampening is effected with at least the pressure which is present in the cylinder chamber 10, and not with a lower pressure which would result in an undesired motion of the piston and of the load. In particular, a sagging through of the load is prevented when the accumulator becomes operative.

To allow a drawing-in of fluid into the piston rod-sided chambers 9 of the lift cylinders 7, the directional control valve 8 provided for the floating position has an additional position "D" in which the line 30 of the piston rod-sided cylinder chambers 9 is connected to the reservoir line 12. The directional control valve 8 is switched into the additional position D by an additional control valve 31 which is actuated together with the three-way valve 25. The flow of the fluid through the valve 8 in the position D may be restricted by providing a stop for the valve plunger in the position D resulting in a throttling action. It is thus possible to provide the communication of the piston rod-sided cylinder chambers to the reservoir by means of a directional control valve 8 which is standard equipment of the valve block of this type.

In the additional position D of the valve 8 the piston rod-sided cylinder chamber 9 is connected through the line 30 and a passage 32 in the valve 8 to the bypass line 33 to which all directional control valves 4, 6, 8 are connected. The bypass line opens into the reservoir line downstream of the last valve 8. Accordingly, when the accumulator is connected to the system, the bypass pressure exists in the piston rod-sided cylinder chamber 9 which bypass pressure is regularly somewhat higher than the reservoir pressure. This makes sure that a bleeding-off of air is prevented during the dampening motions of the working pistons.

We claim:

1. Hydraulic control apparatus for building machinery which includes a hydraulic cylinder, a fluid pressure source and a reservoir, said apparatus comprising: a cylinder-operating directional valve coupled between the pressure source and the cylinder for controlling fluid flow therebetween, a hydraulic accumulator, a filling line directly connected to the cylinder and exposed to the load pressure of the cylinder, and a shut-off valve disposed in said filling line between the cylinder and said accumulator and having a valve member for controlling the flow of fluid therebetween, said filling line being coupled to one side of said valve member so that it is biased in the opening direction by the load pressure of the cylinder, said shut-off valve including a control portion shiftable between a first condition in which said valve member is biased in the closing direction by the accumulator pressure and a second condition in which said valve member is pressure-relieved toward the opening direction.

2. The control apparatus of claim 1, wherein said control portion is a valve which, in the first and second conditions, respectively, connects said accumulator to the other side of said valve member and to the reservoir.

3. The control apparatus of claim 1 or 2, wherein said shut-off valve is a two-way seat valve.

4. The control apparatus of claim 3, wherein the cylinder has a piston-sided cylinder chamber and a rod-sided cylinder chamber, and further comprising a further directional valve downstream of said cylinder-operating directional valve, said further directional valve having a valve plunger disposable in a floating position in which said piston-sided cylinder chamber is connected to said piston rod-sided cylinder chamber, whereby said valve plunger is positioned to connect said piston rod-sided cylinder chamber to the reservoir when said shut-off valve is opened.

5. The control apparatus of claim 4, and further comprising a stop for determining the position of said valve plunger of said further directional valve, whereby the flow of fluid between the reservoir and the piston rod-sided cylinder chamber is restricted.

6. The control apparatus of claim 4, and further comprising a bypass line connected to the reservoir, said directional valves being connected to said bypass line in series, and said further directional valve in the floating position thereof defining a passage between the piston rod-sided cylinder chamber and said bypass line.

7. The control apparatus of claim 5, and further comprising a bypass line connected to the reservoir, said directional valves being connected to said bypass line in series, and said further directional valve in the floating position thereof defining a passage between the piston rod-sided cylinder chamber and said bypass line.

8. The control apparatus of claim 1, wherein when said control portion of said shut-off valve is in its first condition said accumulator pressure is equal to or greater than the load pressure of the cylinder.

* * * * *